United States Patent [19]

Stout

[11] 4,147,290

[45] Apr. 3, 1979

[54] ARTICLE CARRIER HANDLE STRUCTURE

[75] Inventor: James T. Stout, Doraville, Ga.

[73] Assignee: The Mead Corporation, Dayton, Ohio

[21] Appl. No.: 907,546

[22] Filed: May 19, 1978

[51] Int. Cl.[2] ..... B65D 5/46

[52] U.S. Cl. ..... 229/52 B; 206/162

[58] Field of Search ..... 229/52 B, 28 BC; 206/162, 430, 141

[56] References Cited

U.S. PATENT DOCUMENTS

| | | | |
|---|---|---|---|
| 1,982,962 | 12/1934 | McAleer | 229/52 B |
| 3,411,663 | 11/1968 | Moore et al. | 229/28 BC X |
| 3,421,684 | 1/1969 | Stout, Sr. et al. | 229/52 B |
| 3,933,303 | 1/1976 | Kirby, Jr. | 229/52 B |

*Primary Examiner*—Davis T. Moorhead

*Attorney, Agent, or Firm*—Walter M. Rodgers; Walter A. Rodgers

[57] ABSTRACT

Structure for maintaining article carrier handle elements in proper relative orientation during carrier formation and comprising a handle panel (8), a hand flap (11) struck from the handle panel and foldably joined thereto along a horizontal fold line (12), a connecting element (14) joined at one end to the handle panel and at the other end to one end of the hand flap, the upper (16) and lower (17) edges of the connecting element being angularly disposed to the horizontal fold line and downwardly inclined from the one end of the hand flap, and the hand flap being adapted to swing out of the plane of the handle panel during transport of the carrier and thereby to cause the connecting element to rotate.

8 Claims, 4 Drawing Figures

ARTICLE CARRIER HANDLE STRUCTURE

In order to obtain maximum machine speed and output of article cariers during the production process, the elements of the article carrier must be maintained in proper relative orientation. Since certain adjacent elements of the typical carrier are not joined to each other after the carrier is formed, it is necessary temporarily to attach these disjointed parts when the carrier is in blank form in order to prevent any misalignment as the blank travels through the forming machinery and is ultimately formed into a completed and collapsed article carrier.

Of course a relatively small connection between carrier elements is desirable in order to be easily broken. On the other hand a larger connection is desirable in order to hold adjacent elements securely in place during production and thereby to prevent inadvertent breakage of the connection by the forming machinery.

Various connections have been utilized in the past between elements in a completed carrier which are simply moved apart in the same plane. Also dimensionally small connections have been used in carrier handle structures but are undesirable because they are prone to premature breakage during formation of the carrier.

According to this invention, article carrier handle structure is provided and comprises a handle panel, a hand flap struck from the handle panel and foldably joined thereto along a substantially horizontal fold line, a connecting element having upper and lower edges integrally joined at one end thereof to the handle panel and at the other end thereof to one end of the hand flap, the upper and lower edges of the connecting element being angularly disposed to the horizontal fold line and downwardly inclined from the one end of the hand flap, and the hand flap being adapted to swing out of the plane of the handle panel and thereby to cause the connecting element to rotate.

Figure 1:
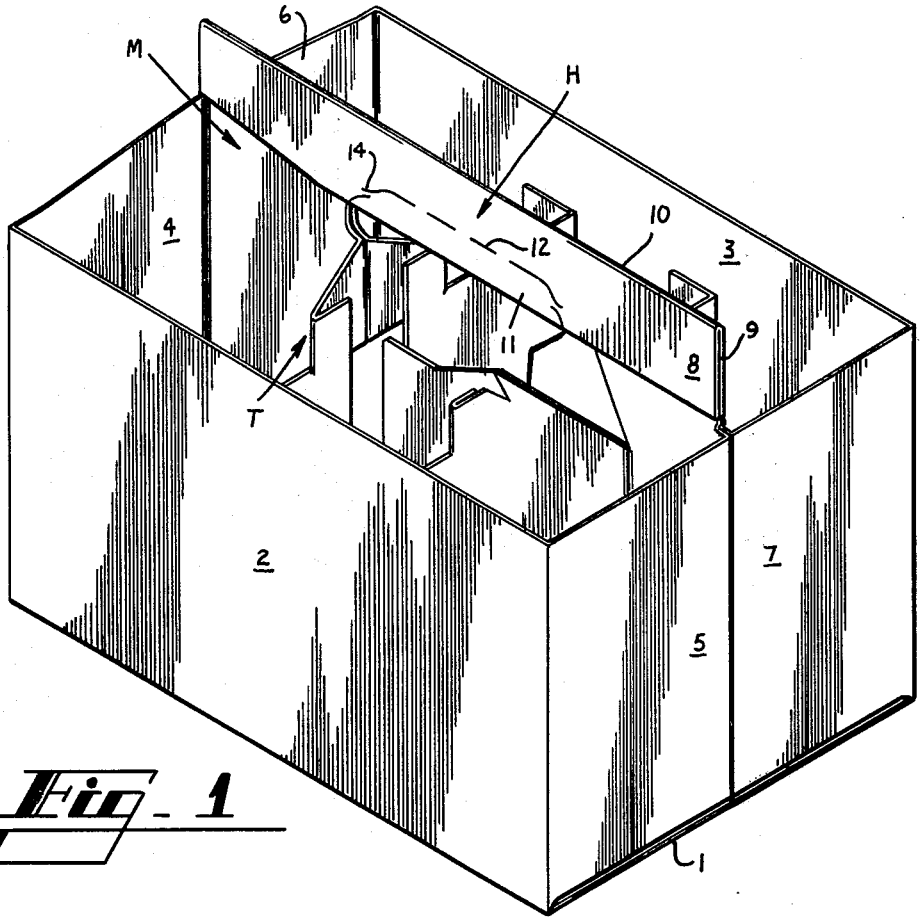
Figure 2:
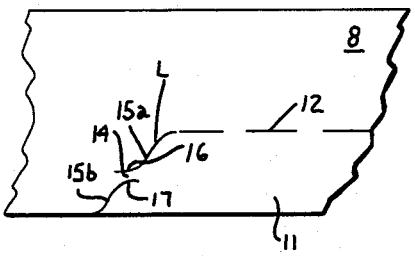
Figure 3:
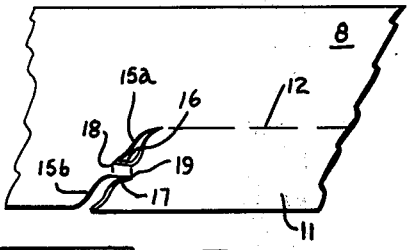
Figure 4:
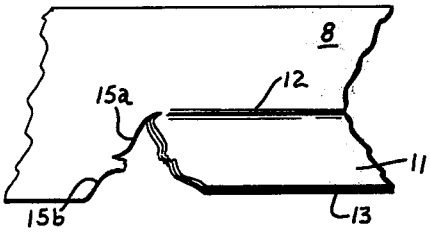

For a better understanding of the invention, reference may be had to the following detailed description taken in conjunction with the accompanying drawing in which FIG. 1 is an isometric view of an article carrier which embodies handle structure constructed according to this invention and in which FIGS. 2, 3 and 4 illustrate the successive stages through which the article carrier hand flaps are manipulated into the hand carrying position.

With reference to the drawing, the numeral 1 designates the bottomwall of the carrier to the side edges of which side walls 2 and 3 are foldably joined. End wall panels 4 and 5 are foldably joined respectively to the end edges of side wall 2. In like manner end wall panels 6 and 7 are foldably joined to the end edges of side wall 3 respectively.

The letter T generally designates the carrier transverse partition structure which is formed in known manner. Also the letter M generally designates the medial partition structure of the carrier, the end edges of which are joined to the inner edges of the respective end wall panels. To complete the basic elements of the carrier, the letter H generally designates the handle structure.

With particular reference to handle structure H, handle panels 8 and 9 are foldably joined along fold line 10 and are disposed in an overlapping relationship with the upper portion of medial partition structure M. In addition hand flap 11 is struck from handle panel 8 and foldably joined thereto along horizontal fold line 12. In like manner hand flap 13 is foldably joined to handle panel 9 by a horizontal fold line which is not shown in detail in the drawing.

According to a feature of this invention, connecting element 14 is integrally formed at one end thereof to handle panel 8 and at the other end thereof to one end of hand flap 11, as best viewed in FIG. 2. A similar connecting element is formed at the opposite end of hand flap 11 as well as at each end of hand flap 13 and since each connecting element is similarly constructed only connecting element 14 will be discussed in detail.

Specifically, connecting element 14 is disposed generally midway along the associated end edge of hand flap 11 and is disposed between upper and lower portions **15*a* and 15*b* of interrupted cut line L. In addition the upper edge 16 and lower edge 17 of connecting element 14 are slightly curved with the point of closest proximity being at the midpoints thereof and both upper edge 16 and lower edge 17 are angularly disposed relative to horizontal fold line 12 and downwardly inclined from the associated end of hand flap 11. Also, as best viewed in FIG. 2, upper edge 16 is substantially disposed in handle panel 8 and lower edge 17 is substantially disposed in hand flap 11**.

Whenever it is desired to transport the carrier, hand flaps 11 and 13 are swung respectively out of the planes of handle panels 8 and 9 in known manner. As this occurs, and since upper edge 16 and lower edge 17 of connecting element 14 are angularly disposed to horizontal fold line 12 and downwardly inclined from the associated end of hand flap 11, connecting element 14 is caused to rotate out of the plane of handle panel 8. In addition the slightly curved configuration of both upper edge 16 and lower edge 17 tends to facilitate the initiation of rotation of connecting element 14.

As the amount of rotation increases, a tension force is created at point 18 between the outer end of upper edge 16 and the associated portion of handle panel 8. Simultaneously a tension force is created at point 19 between the inner end of lower edge 17 and the adjacent portion of hand flap 11. Due to this tension, severance between hand flap 11 and handle panel 8 is normally initiated at either point 18 or point 19. Since the tension is concentrated at only two points of initiation of tearing, a connection can be utilized which is substantially larger than would be required if no rotation of the connecting element were involved. Of course as hand flap 11 is swung out of the plane of handle panel 8 to a greater degree, complete severance occurs as shown in FIG. 4.

Therefore by this invention an improved connection between an article carrier hand flap and the associated handle panel is provided which is dimensionally large enough to resist premature severance during formation of the carrier and at the same time is easily broken, as required, whenever the carrier hand flap is manipulated in the normal manner.

The embodiments of the invention in which an exclusive property or privilege is claimed are defined as follows:

1. In an article carrier, handle structure comprising a handle panel, a hand flap struck from said handle panel and foldably joined thereto along a substantially horizontal fold line, a connecting element having upper and lower edges and being integrally joined at one end thereof to said handle panel and at the other end thereof to one end of said hand flap, said upper and lower edges of said connecting element being angularly disposed to said horizontal fold line and downwardly inclined from said one end of said hand flap, and said hand flap being adapted to swing out of the plane of said handle panel and thereby to cause said connecting element to rotate.

2. Handle structure according to claim 1 wherein a tension force occurs during the swinging of said hand flap out of the plane of said handle panel between the inner end of the lower edge of said connecting element and the adjacent portion of said hand flap.

3. Handle structure according to claim 1 or 2 wherein a tension force occurs during the swinging of said hand flap out of the plane of said handle panel between the outer end of the upper edge of said connecting element and the adjacent portion of said handle panel.

4. Handle structure according to claim 1 wherein a second connecting element having upper and lower edges is integrally joined at one end thereof to said handle panel and at the other end thereof to the other end of said hand flap and wherein the upper and lower edges of said second connecting element are angularly disposed to said horizontal fold line and are downwardly inclined from said other end of said hand flap.

5. Handle structure according to claim 1 wherein said connecting element is disposed generally midway along said one end of said hand flap.

6. Handle structure according to claim 1 wherein said upper and lower edges of said connecting element are slightly curved.

7. Handle structure according to claim 6 wherein the point of closest proximity between said upper and lower edges is generally at the midpoint of said connecting element.

8. Handle structure according to claim 1 wherein said upper edge is substantially disposed in said handle panel and wherein said lower edge is substantially disposed in said hand flap.

* * * * *